US008915752B2

(12) United States Patent
Ariesen

(10) Patent No.: US 8,915,752 B2
(45) Date of Patent: Dec. 23, 2014

(54) CABLE CONNECTOR HAVING A SEAL

(75) Inventor: Dirk Jan Ariesen, Veenendaal (NL)

(73) Assignee: Technetix Group Limited, Burgess Hill (GB)

( * ) Notice: Subject to any disclaimer, the term of this patent is extended or adjusted under 35 U.S.C. 154(b) by 96 days.

(21) Appl. No.: 13/639,232

(22) PCT Filed: Apr. 6, 2011

(86) PCT No.: PCT/GB2011/050681
§ 371 (c)(1),
(2), (4) Date: Oct. 25, 2012

(87) PCT Pub. No.: WO2011/128665
PCT Pub. Date: Oct. 20, 2011

(65) Prior Publication Data

US 2013/0040490 A1 Feb. 14, 2013

(30) Foreign Application Priority Data

Apr. 12, 2010 (GB) ..... 1006063.0
Jul. 20, 2010 (GB) ..... 1012159.8
Dec. 8, 2010 (GB) ..... 1020788.4

(51) Int. Cl.
*H01R 9/05* (2006.01)
*H01R 13/52* (2006.01)
*H01R 13/6599* (2011.01)
*H01R 24/40* (2011.01)

(52) U.S. Cl.
CPC ..... *H01R 9/0521* (2013.01); *H01R 9/0527* (2013.01); *H01R 13/5202* (2013.01); *H01R 13/6599* (2013.01); *H01R 24/40* (2013.01)
USPC ..... 439/578

(58) Field of Classification Search
USPC ..... 439/578, 583
See application file for complete search history.

(56) References Cited

U.S. PATENT DOCUMENTS 6,241,553 B1 6/2001 Hsia
6,261,126 B1 7/2001 Stirling
7,976,339 B2 * 7/2011 Buck et al. ..... 439/578

(Continued)

FOREIGN PATENT DOCUMENTS

EP 0428424 A2 5/1991
EP 1207586 A2 5/2002

(Continued)

OTHER PUBLICATIONS

English-language abstract of Japanese Patent No. 2001351725A, European Patent Office, Dec. 21, 2001.

(Continued)

*Primary Examiner* — Hae Moon Hyeon
(74) *Attorney, Agent, or Firm* — DASCENZO Intellectual Property Law, P.C.

(57) ABSTRACT

There is provided a cable connector (10) comprising a body (12) joined to a connector ring (14) for securing to a female connector (20), wherein a seal (26) is placed between the body (12) and the connector ring (14). The use of the seal or gasket (26) prevents electromagnetic leakage from and into the connector. The connector ring can be provided with an inner recess (28) housing a ring spring (30) so as to grip a female connector tightly and prevent electromagnetic leakage where the connector mounts to the female connector.

6 Claims, 3 Drawing Sheets

(56) References Cited

U.S. PATENT DOCUMENTS

| | | | | |
|---|---|---|---|---|
| 8,047,872 | B2 * | 11/2011 | Burris et al. | 439/582 |
| 2003/0224657 | A1 | 12/2003 | Malloy | |
| 2004/0102089 | A1 * | 5/2004 | Chee | 439/578 |
| 2005/0233636 | A1 | 10/2005 | Rodrigues et al. | |
| 2006/0110977 | A1 * | 5/2006 | Matthews | 439/578 |
| 2007/0175027 | A1 | 8/2007 | Khemakhem et al. | |
| 2008/0102696 | A1 * | 5/2008 | Montena | 439/578 |
| 2008/0171466 | A1 * | 7/2008 | Buck et al. | 439/578 |
| 2009/0176396 | A1 * | 7/2009 | Mathews | 439/271 |
| 2010/0035457 | A1 * | 2/2010 | Holliday | 439/345 |
| 2010/0087090 | A1 * | 4/2010 | Islam | 439/578 |
| 2010/0093211 | A1 * | 4/2010 | Sutter | 439/578 |
| 2011/0117774 | A1 * | 5/2011 | Malloy et al. | 439/578 |

FOREIGN PATENT DOCUMENTS

| | | | |
|---|---|---|---|
| EP | 1548898 | A1 | 6/2005 |
| GB | 2019665 | A | 10/1979 |
| GB | 2135533 | A | 8/1984 |
| JP | 2001351725 | A | 12/2001 |
| JP | 2002075556 | A | 3/2002 |
| WO | WO 98/28822 | | 7/1998 |
| WO | WO 2004/095641 | A2 | 11/2004 |
| WO | WO 2006/057737 | A1 | 6/2006 |
| WO | WO 2008/051740 | A2 | 5/2008 |

OTHER PUBLICATIONS

English-language abstract of Japanese Patent No. 2002075556A, European Patent Office, Mar. 15, 2002.

* cited by examiner

CABLE CONNECTOR HAVING A SEAL

FIELD OF THE INVENTION

This invention relates to a cable connector such as is used to mount a cable onto a female connector associated with a device.

BACKGROUND TO THE INVENTION

Cable connectors are joined to the end of cables so that the cable can engage with a connector on an electrical device. Normally a male connector is secured to the cable, with a female connector on the device. To mount the cable to the device, the male connector is screwed or pushed onto the female connector. With screw connectors, it is very important that the male connector is screwed with the correct torque to the female connector as otherwise the connection is not sufficiently secure to prevent electromagnetic signals leaking from the device or external signals entering the device and introducing noise into the electrical system. Even if the male connector is screwed into position correctly with no electromagnetic leakage occurring, over time a connector will slowly loosen due to the different thermal conductivity of materials used, vibrations, cold flow and the like. Thus over time the connector is likely to leak or receive electromagnetic radiation.

SUMMARY OF THE INVENTION

Cable connectors according to the present disclosure include a body formed with a central channel and joined to a connector ring for securing to a female connector, a seal positioned between adjoining faces of the body and the connector ring substantially perpendicular to a longitudinal axis of the body. The seal has a greater central diameter than the central channel. The connector ring is formed with an inner recess in which at least one electrically conductive resilient member is seated. A further electrically conductive resilient member surrounds an internal metal collar positioned within the central channel of the body.

DESCRIPTION

Figure 1:
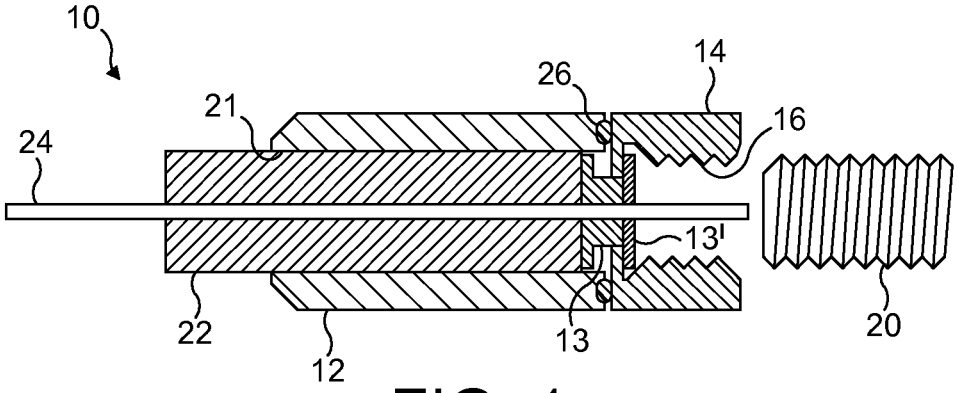
FIG. 1 shows a section through a cable connector in accordance with a first aspect of the invention.

In accordance with the first aspect of the present invention, there is provided a cable connector comprising a body formed with a central channel and joined to a connector ring for securing to a female connector, wherein a sealing means is positioned between adjoining faces of the body and connector, the faces of the body and the connector being substantially perpendicular to a longitudinal axis of the body. The use of the sealing means or gasket reduces electromagnetic leakage from and into the connector.

Preferably the connector ring has an internal thread, such that the connector is of a screw type.

The sealing means may be deformable to fill any space between the body and connector ring.

Preferably the sealing means acts to urge the connector ring away from the body whilst remaining in permanent contact with both the body and the connector ring.

Typically the body and connector ring are substantially cylindrical and thus the sealing means is preferably annular so as to completely surround a region where the body and connector ring adjoin. The sealing means may be a rubber o-ring or a metal gasket.

Desirably the annular sealing means has a greater internal diameter than the central channel of the body, such that the sealing means is external to the internal channel.

The connector may further comprise a resilient member surrounding an internal metal collar positioned within the central channel of the body. The resilient member may comprise an electrically conductive ring spring.

In accordance with a second aspect of the invention, there is provided a cable connector comprising a body joined to a connector ring for securing to a female connector, wherein the connector ring comprises at least one resilient member. As a female connector is screwed into the connector ring, the at least one resilient member urges against the female connector and when the female connector is fully inserted, the resilient member firmly grips the female connector such that leakage of electromagnetic signals is prevented. The resilient member also has the advantage of absorbing vibrations and so ensures the connector stays firmly connected for longer.

In accordance with a third aspect of the present invention, there is provided a cable connector comprising a body joined to a connector ring for securing to a female connector, wherein a sealing means is placed between the body and connector ring and the connector ring is formed with an inner recess means in which at least one resilient member is seated.

For all aspects, the resilient member is preferably an electrically conductive resilient material which is substantially annular in shape, such as a ring spring, gasket or equivalent such as resilient plastics material loaded with conductive particles, resilient metal materials or similar resilient materials that can be formed into an annulus or toroid.

For the second and third aspects, the recess means may be in the form of a circumferential groove with the resilient member having a co-operating annular shape so as to locate securely in the recess means.

FIG. 1 is a section through a cylindrical cable connector 10 comprising body 12 secured by metal collar 13 and post plate 13' to connector ring or rotating nut 14. Connector ring 14 is formed with an internal screw thread 16 for receiving female connector 20 which has a co-operating thread. Body 12 is hollow with an internal channel 21 which receives coaxial cable 22 with central conductive core 24. The coaxial cable 22 is shown to indicate how the male connector 10 secures such a cable.

Adjoining faces of body 12 and nut 14 are substantially perpendicular to the longitudinal central axis of body 12 and positioned between these faces is a seal or gasket 26 made of a resilient electrically insulating material such as rubber. The gasket is toroidal, for example a ring, and has a similar annular diameter, to the cross section or wall thickness of hollow body 12, such that the gasket does not extend into the internal channel 21. The cross section of material forming the o-ring 26 is typically around 0.5 mm. Due to its resilience, seal 26 urges the nut 14 against post plate 13'. The o-ring 26 applies an equal pressure to the nut 14 where the two adjoin and so the nut 14 is always pushed equally to the post plate 13'. Thus the nut 14 sits square to the post plate 13' and the adjoining surfaces of the nut 14 and post plate 13' are pushed together with no air gap between the adjoining surfaces. This has the effect of preventing or substantially reducing electromagnetic leakage at the back end of the male connector 10 and gives 90 dB screening up to 1 GHz.

Figure 2:
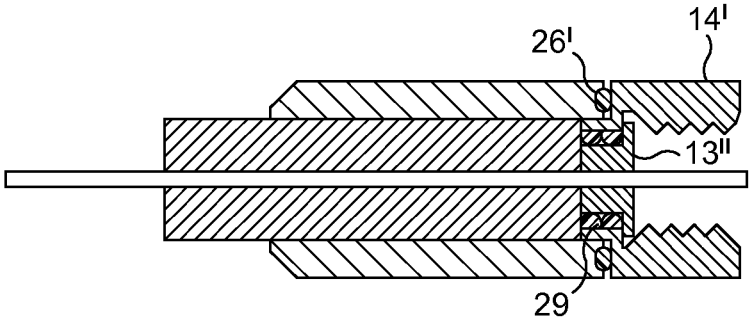
FIG. 2 shows a section through a cable connector in accordance with a second embodiment.

FIG. 2 shows a second embodiment of the present invention where o-ring 26' is used in combination with ring spring 29 to close the gap between spinning nut 14' and body 12 which as shown in FIG. 1 typically includes retaining member 13" equivalent to collar 13 and post plate 13'. In this arrangement, o-ring 26' has a reduced cross section when compared to o-ring 26 which makes it easier to manually tighten spinning nut 14' with respect to body 12. However the reduction in cross sectional diameter of the o-ring reduces the effectiveness of sealing in relation to electromagnetic leakage at the back end of the connector when compared to the version shown in FIG. 1. Thus in the second embodiment, an internal ring spring 29 is located around collar and post plate 13" and in combination, o-ring 26' and ring spring 29 act to prevent leakage or ingress of electromagnetic signals into the back end of the connector. The ring spring is typically made from a conductive material, such as metal, and in particular copper.

Figure 3:
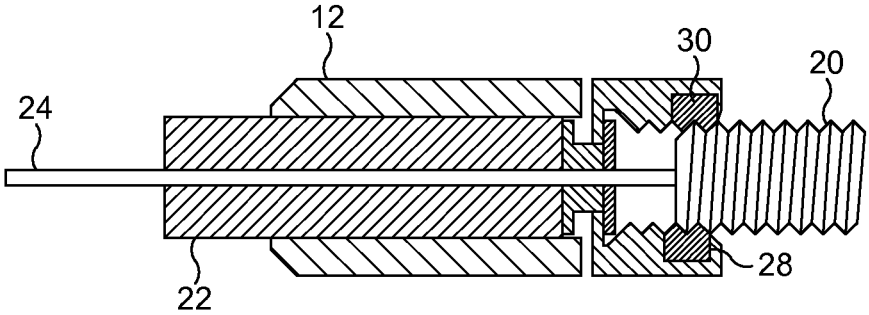
FIG. 3 shows a section through a cable connector in accordance with a third embodiment.

In a third embodiment of the present invention as shown in FIG. 3, connector ring 14 is formed with an internal annular recess 28 within which sits electrically conductive resilient ring spring 30. The annular ring spring 30 grips female connector 20 as it is screwed into connector ring 14 and when female connector 20 is fully engaged, spring 30 pushes radially inwards towards female connector 20 to grip it tightly. This tight connection ensures that no air gap exists between the connector 20 and ring 14 and prevents leakage as long as the female connector is partially mounted within the male connector. Signal leakage is prevented at this front end of the male connector 10 even after female connector 20 has been loosened by two full turns. Spring 30 is also of advantage as it absorbs vibrations and so reduces the loosening effect these vibrations have on connector 20, so ensuring that connector 20 remains in a electromagnetic leak free position for longer.

Figure 4:
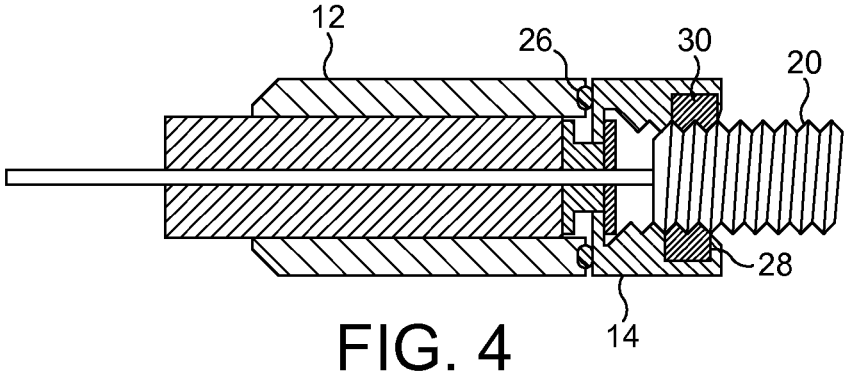
FIG. 4 shows a section through a cable connector in accordance with a fourth embodiment.
Figure 5:
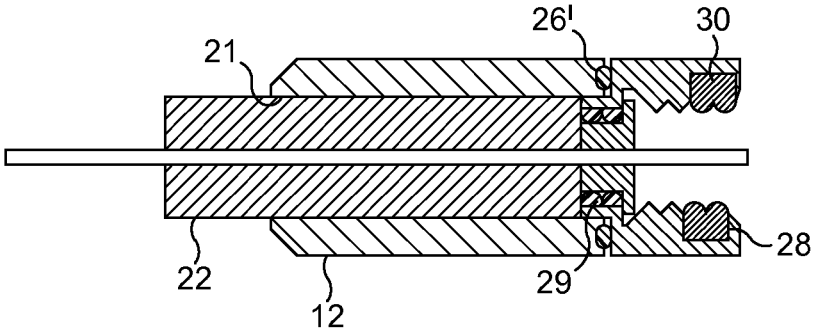
FIG. 5 shows a section through a cable connector in accordance with a fifth embodiment.

A fourth embodiment of the dimension is shown in FIG. 4, where all features of the invention as disclosed in relation to FIGS. 1 and 3 are combined in a single connector, in particular rubber o-ring 26 and ring spring 30. A fifth embodiment is shown in FIG. 5 where the features of the second and third embodiments are combined.

The connectors of the present invention are all able to meet Class A screening requirements even when the female connector has been substantially loosened with respect to the nut 14.

Figure 6:
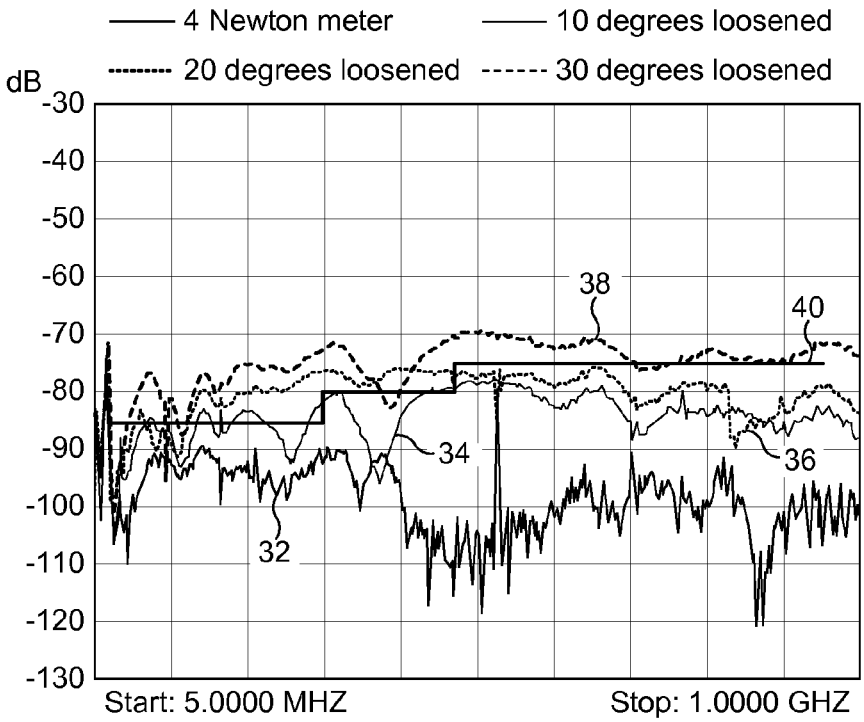
FIG. 6 shows a graph illustrating signal leakage for a prior art connector.
Figure 7:
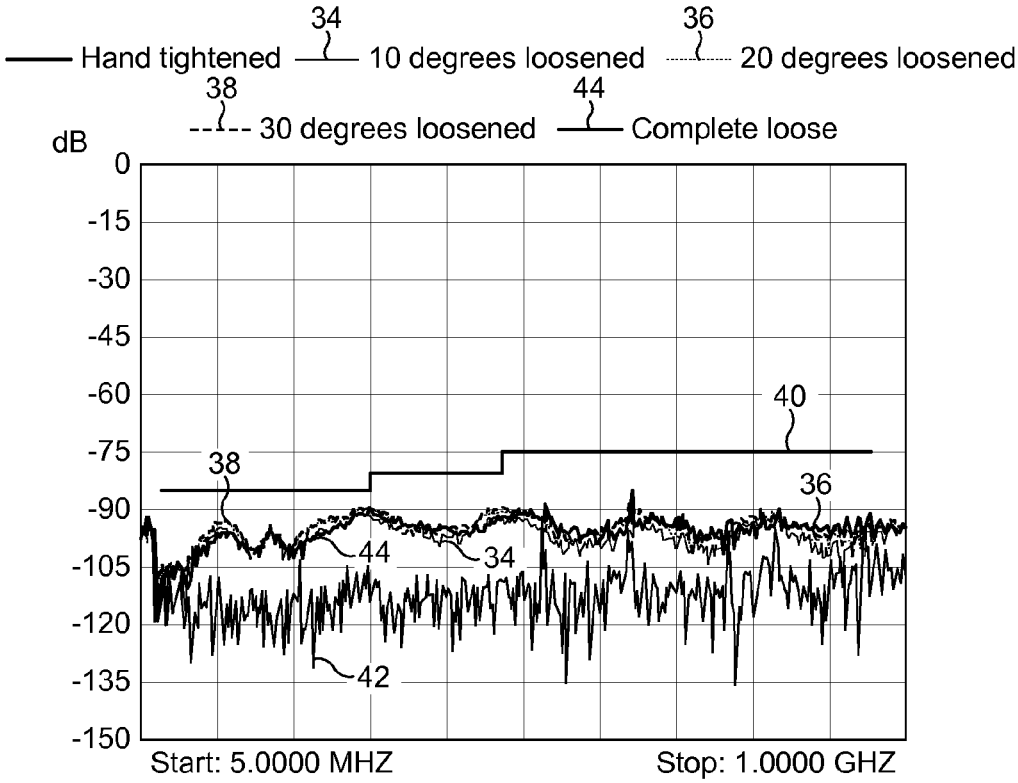
FIG. 7 shows a graph illustrating signal leakage for a connector in accordance with the present invention.

The improvements with regard to signal leakage can be demonstrated by comparing with a known prior art connector, see FIGS. 6 and 7. FIG. 6 shows a graph comparing signal leakage or noise over a frequency range of 5 MHz to 1 GHz for a prior art connector as it is loosened. The different traces represent the connector tightened to 4 Newton Meter, trace 32, loosened by 10 degrees, trace 34, loosened by 20 degrees, trace 36, and loosened by 30 degrees, trace 38. Solid stepped line 40 represents acceptable signal leakage levels at given frequencies and represents the characteristics required of a connector classified as a Class A connector. This prior art connector is similar to that disclosed in EP 1207586 and includes an internal o-ring positioned between a seal nut and collar.

As will be seen from FIG. 6, as the prior art connector is loosened with respect to a cable mounted within it signal leakage increases to be in excess of the Class A requirement when the connector is loosed by at least 20 degrees.

In contrast, the signal leakage of a connector in accordance with the second and third embodiment of the present invention, and as seen in FIG. 4, is shown in FIG. 7 with trace 42 showing the signal leakage characteristics for such a connector when hand tightened and trace 44 showing the characteristics when completely loose by two turns. Even when the connector is completely loosened by two full turns, the signal leakage characteristics are still compliant with the requirements needed for a connector classified as a Class A connector. With a connector according to the present invention, the signal leakage characteristics are very similar from 10 degrees loosened to completely loose at two turns loose.

The invention claimed is:

1. A cable connector comprising a body formed with a central channel and joined to a connector ring for securing to a female connector, a seal positioned between adjoining faces of the body and the connector ring substantially perpendicular to a longitudinal axis of the body and the seal having a greater central diameter than the central channel, the connector ring being formed with an inner recess in which at least one electrically conductive resilient member is seated, wherein a further electrically conductive resilient member surrounds an internal metal collar positioned within the central channel of the body.

2. The cable connector according to claim 1, wherein the connector ring has an internal thread.

3. The cable connector according to claim 1, wherein the seal is deformable.

4. The cable connector according to claim 1, wherein the seal acts to urge the connector ring away from the body whilst remaining in permanent contact with both the body and the connector ring.

5. The cable connector according to claim 1, wherein the resilient member is a ring spring.

6. The cable connector according to claim 1, wherein the inner recess is in the form of a circumferential groove with the electrically conductive resilient member having a co-operating annular shape.

* * * * *